United States Patent [19]

Wilson et al.

[11] Patent Number: 4,709,924

[45] Date of Patent: Dec. 1, 1987

[54] ADJUSTABLE BATTING TEE

[75] Inventors: Richard A. Wilson; Joseph C. Barbaglia, both of Centerville, Iowa

[73] Assignee: Robert L. Wright, Des Moines, Iowa

[21] Appl. No.: 783,852

[22] Filed: Oct. 3, 1985

Related U.S. Application Data

[63] Continuation-in-part of Ser. No. 626,886, Jul. 2, 1984, abandoned.

[51] Int. Cl.[4] ..... A63B 69/40

[52] U.S. Cl. ..... 273/26 R

[58] Field of Search ..... 273/26 R, 202, 26 A, 273/55 R, 29 A, 25, 208

[56] References Cited

U.S. PATENT DOCUMENTS

| | | | |
|---|---|---|---|
| 1,755,344 | 4/1930 | Acaster | 273/202 |
| 1,803,907 | 5/1931 | Kruse | 273/202 |
| 2,527,906 | 10/1950 | Bennett et al. | 273/26 R |
| 2,694,316 | 12/1960 | Rose | 273/26 R |
| 3,139,282 | 6/1964 | Lande | 273/26 R |
| 3,489,411 | 1/1970 | Morelli et al. | 273/26 R |
| 3,804,410 | 4/1974 | Gilman | 273/55 R |
| 3,934,343 | 4/1960 | Schumacher | 273/55 R |
| 4,227,691 | 10/1980 | Lefelver et al. | 273/26 R |
| 4,445,685 | 5/1984 | Cardieri | 273/26 R |

*Primary Examiner*—Richard C. Pinkham
*Assistant Examiner*—T. Brown
*Attorney, Agent, or Firm*—Zarley, McKee, Thomte, Voorhees & Sease

[57] ABSTRACT

An adjustable batting tee is provided which includes a first plate member shaped like home plate, a second plate member spaced apart from the first plate member and an elongated armature adjustably interconnecting the first and second plate members such that the relative position of the second plate member with respect to the first plate member can be selectively adjusted. An upright ball support member is attached to the second plate member for supporting a ball to be hit that includes telescoping post members which permit the height of the ball to be selectively adjusted. The armature and uppermost post are flexible so as to absorb the forces generated by the user hitting the ball or ball support member.

8 Claims, 10 Drawing Figures

ADJUSTABLE BATTING TEE

BACKGROUND OF THE INVENTION

This is a continuation-in-part of application Ser. No. 626,886, filed July 2, 1984 (now abandoned).

Batting tees are well known for use in improving the hitting of baseball players. Batting tees typically have a support member shaped like home plate with a pipe or post extending upwardly therefrom and terminating in a flexible piece of rubber upon which a baseball or softball to be hit may be supported. The height of the ball upon the tee is usually adjustable to simulate high and low pitches, as well as for use by different sized players.

Also, the upright ball support is usually fixed in the center of the plate and stationary with respect to the edges of the plate. Such conventional batting tees wherein the ball support is fixed in the center of the plate lack ability to simulate inside and outside pitches for the hitter. Furthermore, ideally, the ball should be hit in front of the plate rather than over the plate. Such proper hitting technique cannot be taught by the conventional single-position batting tee.

Some batting tees mount the tee on an adjustable arm, such that the ball can be moved to various positions with respect to the plate. U.S. Pat. Nos. 3,139,282, issued to Lande, and 3,489,411 issued to Morelli, are examples of such adjustable tees. The arms of these adjustable tees are thick and rigid so as to support the tee at the desired position. When a user hits the ball on tee, the rigidity of the support arm transmits the hitting forces to the plate. Such transmission of forces causes damage to the connection of the arm to the plate and causes the plate to move undesirably upon the support surface.

Thus, a primary objective of the present invention is the provision of an improved batting tee.

A further objective of the present invention is the provision of an adjustable batting tee having a tee supporting arm which absorbs the forces generated by the user.

Another objective of the present invention is the provision of an adjustable batting tee which can support a ball to be hit in the various positions within the strike zone.

A further objective of the present invention is the provision of an adjustable batting tee in which the height of the ball to be supported thereby can be varied.

Another objective of the present invention is the provision of an adjustable batting tee when the relative inside and outside position of the ball with respect to the plate can be selectively adjusted.

Still a further objective of the present invention is the provision of an adjustable batting tee which supports the ball in front of the plate.

A further objective of the present invention is the provision of a batting tee which enhances proper batting stance, stride and swing movements.

Another objective of the present invention is the provision of an adjustable batting tee which can be used to teach a hitter to properly address the ball by providing game-like relationships between the batter, the ball and home plate.

SUMMARY OF THE INVENTION

The adjustable batting tee of the present invention includes a first plate member shaped like home plate and a second plate member spaced apart from the first plate member. An upright ball support means is attached to the second plate member for supporting a ball to be hit. An elongated flexible armature adjustably interconnects the first plate member with the second plate member such that the relative position of the second plate member with respect to the first plate member is selectively adjustable. Attachment means connected to each of the first and second plate members is adapted to engage the armature and permits relative longitudinal or pivotal movement of the armature and plate members. The armature is flexible so as to absorb any forces generated when the user hits the ball or tee, thereby minimizing the transmission of such forces to the first plate member.

DETAILED DESCRIPTION OF THE DRAWINGS

Figures 1, 2, 3, 4, 5, 6:
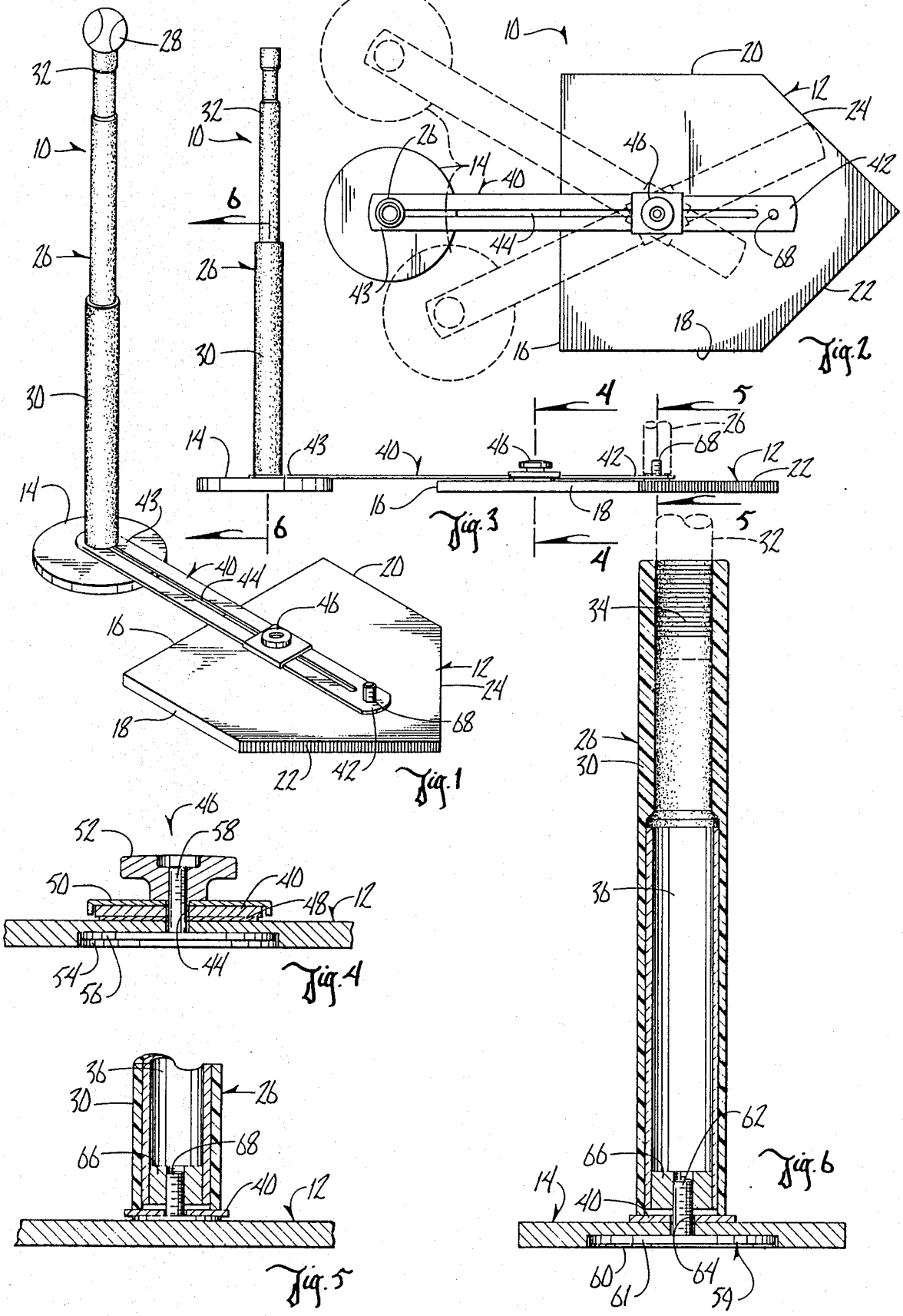
FIG. 1 is a perspective view of the batting tee of the present invention with the tee being connected to the second plate member which in turn is adjustably connected to the first plate member by the flexible armature.
FIG. 2 is top plan view of the batting tee showing the adjustability of the tee.
FIG. 3 is a side elevational view of the batting tee.
FIG. 4 is a sectional view taken along line 4—4 of FIG. 3.
FIG. 5 is a sectional view taken along line 5—5 of FIG. 3, with the ball support mounted in an alternative position on the first plate member.
FIG. 6 is a sectional view taken along lines 6—6 of FIG. 3.

In the drawings, the numeral 10 generally designates the batting tee of the present invention. Batting tee 10 includes a first plate member 12 shaped like home plate and a second plate member 14 spaced apart therefrom. First plate member 12 has a forward edge 16, opposite side edges 18 and 20 and rearward edges 22 and 24. As seen in the drawings, second plate member 14 has substantial area for contacting the support surface, but is smaller in area than first plate member 12.

Figure 10:
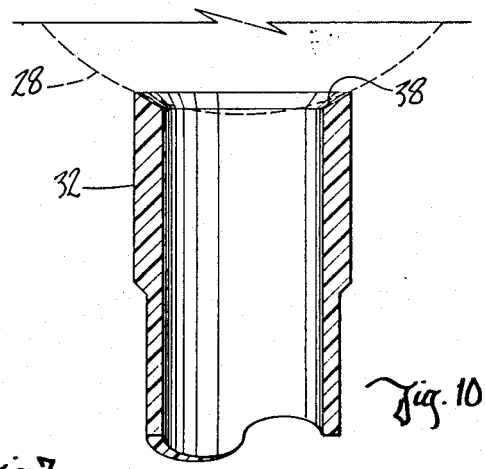
FIG. 10 is a view showing the concave upper end of the ball support member.

A ball support member 26 extends upwardly from second plate member 14 to support a ball 28. Ball support member 26 includes a lower post 30 and an upper post 32 telescopically fit over or into lower post 30 for sliding movement therealong. Upper post 32 may be locked into position along lower post 30 in any convenient manner. For example, the drawings show the upper end of lower post 30 as having a plurality of ribs 34 on the inside surface thereof for frictionally engaging upper post 32. At least upper post 32 is made of a resilient material so as to partially absorb the shock when ball 28 or the post is hit by the batter. Preferably, lower post 30 is also made of a substantially rigid yet resilient material, but may include a metal liner post 36 for additional strength, as seen in FIG. 6. The upper end 38 of upper post 32 is concave so as to easily support ball 28, as seen in FIG. 10.

An elongated flexible structure 40 having opposite ends 42 and 43, adjustably interconnects first plate member 12 and second plate member 14 such that the relative position of the second plate with respect to the first plate member is selectively adjustable. Armature 40 has an elongated slot 44 extending along the length thereof, or in the alternative, a series of holes extending along the length thereof (not shown).

Figure 7:
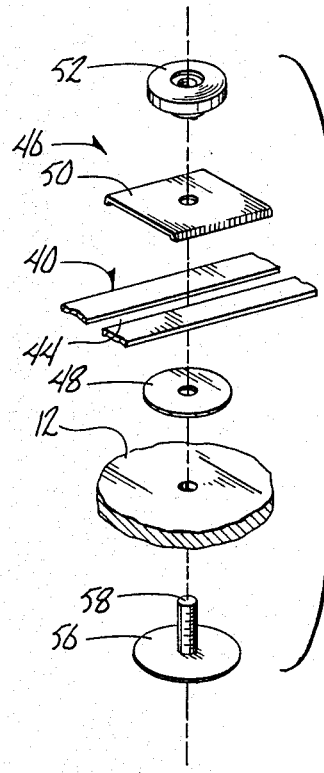
FIG. 7 is an exploded perspective view showing the means of attaching the armature to the first plate member.

As seen in FIGS. 4 and 7, a first attachment means 46 is connected to first plate member 12 and is adapted to adjustably secure armature 40 to first plate member 12. First attachment means 46 includes a large washer 48 positioned on the upper surface of first plate member 12, a clamp member 50 and a handle or knob 52. First plate member 12 has a recessed area 54 in the lower surface thereof adapted to receive the head 56 of a bolt member 58 which extends upwardly through first plate member 12, washer 48, slot 44 in armature 40, clamp member 50, and handle 52. Handle 52 includes interior threads adapted to matingly receive the threaded portion of bolt member 58, such that armature 40 is connected to plate 12. It is understood that the precise structure of attachment means 46 can be varied without departing from the scope of the present invention.

Figure 8:
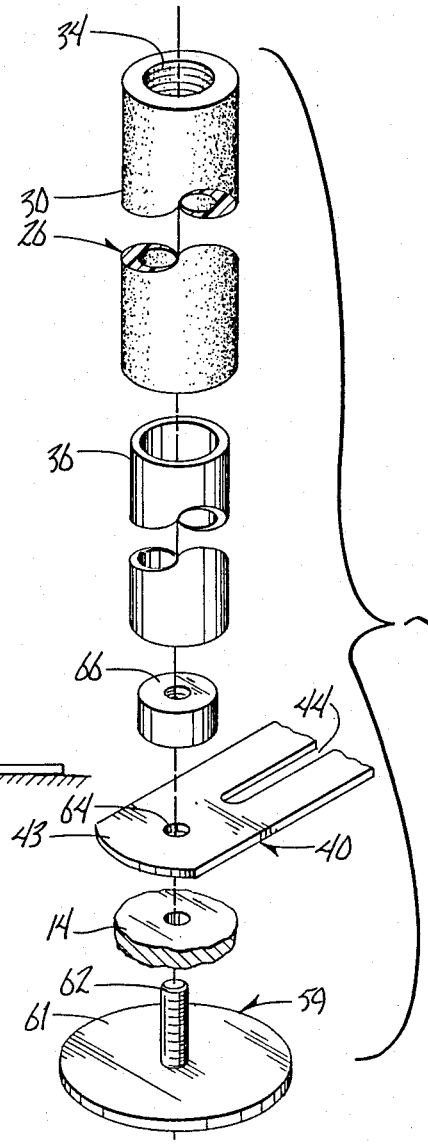
FIG. 8 is an exploded view showing the attachment of the ball support member and the armature to the second plate member.

FIGS. 6 and 8 shows the second fastener means 59 for connecting armature 40 to second plate member 14. Second plate member 14 includes a recessed area 60 in the lower surface thereof adapted to receive the head 61 of a bolt member 62. Bolt member 62 extends upwardly through second plate member 14 and through a hole 64 in end 43 of armature 40. The lower end of post 30 includes a plug 66 having a threaded hole for receiving bolt member 62. Thus, ball support 26 can be secured to second plate member 14 by threading post 30 tightly upon bolt member 62. In the alternative, ball support 26 can be threaded onto a threaded stub or bolt 68 extending upwardly from end 42 of armature 40, as seen in FIG. 5, such that ball 28 can be positioned directly over first plate member 12, as represented by broken lines in FIG. 3.

It is desirable to hit a baseball when it is within the batter's strike zone. Also, it is desirable to hit the ball when it is at a position in front of homoe plate, thus allowing the batter's wrist to roll or snap as the ball is hit, thereby producing increased momentum of the bat for hitting power. Furthermore, it is desirable to hit ground balls or line drives, rather than pop-ups or fly balls. To hit grounders or lines drives, the batter must hit the upper half of the ball. In other words, the ball must be hit at a point at or above a horizontal line bisecting the ball. Hitting the ball below such a horizontal line produces undesirable fly balls.

In use, posts 30 and 32 of ball support 26 are telescopically adjusted such that ball 28 will be at the desired height within the batter's strike zone. Handle 52 of first attachment means 46 is loosened and armature 40 slid along and pivoted about bolt member 58 until second plate member 14 is in the desired position relative to first plate member 12. Handle 52 is then tightened to clamp and hold armature 40 in the selected position. Thus, first attachment means 46 permits second plate matter 14 to be moved forwardly and rearwardly with respect to first plate member 12, as well as laterally with respect to opposite side edges 18 and 20 thereof, as indicated by the dotted lines in FIG. 2. Accordingly, with ball support 26 secured to bolt member 62, ball 28 is positioned in front of first plate 12 and within the batter's strike zone for hitting.

The ability to adjust the position of second plate member 14 with respect to first plate member 12, and the ability to adjust the height of ball support 26, permits the ball to be positioned at the various locations within the strike zone. Such positioning ball 28 in a preferred hitting zone provides the proper relationship between the batter, the ball, and home plate. Proper batting stance, stride and swing is thus enhanced by th adjustable batting tee of the present invention.

The batter generates great forces when ball 28 or ball support 26 are hit. If batting tee 10 does not absorb such forces, the entire device has a tendency to move undesirably upon the surface supporting the tee. Accordingly, it is desirable that batting tee 10 absorb the forces generated by the batter so as to remain in a fixed position upon the support surface.

Figure 9:
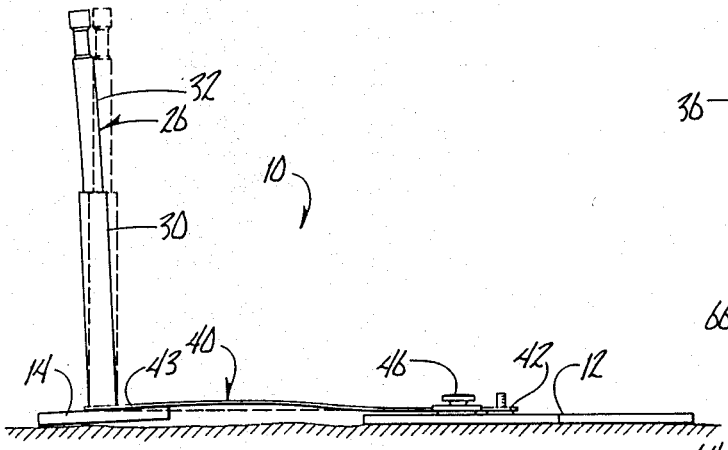
FIG. 9 is a side elevational view showing the flexibility of the armature.

The resilient or flexible nature of upper post 32 partially absorbs such forces. The remaining forces are absorbed by the flexible nature of armature 40. Such flexibility is inherent in the construction of armature 40, which is a thin metal strap, as shown in the drawings. The thickness of armature 40 can be minimized since second plate member 14 having substantial area supports ball support member 26 on the support surface, rather than the ball support member being supported by the armature, as in the prior art. The minimal thickness of armature 40 is such that when the batter hits ball 28 or ball support member 26, ball support 26 and second plate 14 tip forwardly while the armature bows upwardly between opposite ends 42, 43 thereof as best seen in FIG. 9. Thus, little or no force is transmitted to first attachment means 46 or first plate member 12, thereby minimizing damage to attachment means 46 and eliminating movement of batting tee 10 during use.

Thus, the improved batting tee of the present invention accomplishes at least all of the stated objectives.

What is claimed is:

1. An adjustable batting tee for use on ground and floor support surfaces, comprising:

a first plate member positioned on said support surface;

a second plate member positioned on said support surface and spaced apart from said first plate member, said second plate member having substantial area for contact with said support surface but being smaller in area than said first plate member;

an upright ball support means attached to said second plate member for supporting a ball to be hit; and an elongated flexible armature having a first end connected to said first plate member by a first fastener means and a second end connected to said second plate by a second fastener means, at least one of said first and second fastener means beng adjustable such that the relative position of said second plate member with respect to said first plate member is selectively adjustable;

said second plate member being adapted to tip on said support surface in response to a bat impacting said ball or said ball support means such that said armature flexes upwardly between the ends thereof to absorb the forces of impact and thereby minimizes transmission of forces from said ball support means to said first fastener means and whereby movement of said first plate member with respect to said support surface is substantially eliminated.

2. The batting tee of claim 1 wherein said armature is a thin metal strap.

3. The batting tee of claim 1 wherein said armature includes an elongated slot through which said first attachment means extends for pivotally and longitudinally adjusting the position of said second plate member relative to said first plate member.

4. The batting tee of claim 1 wherein said armature is pivotally and longitudinally movable with respect to said first attachment means.

5. The batting tee of claim 1 wherein said first plate member has a forward edge, opposite side edges, and a rearward portion, said armature interconnecting said first and second plate member such that said second plate member is movable forwardly, rearwardly and laterally with respect to said forward edge of said first plate member.

6. The batting tee of claim 1 wherein said ball support means includes an elongated lower section and an elongated upper section adjustably telescoping from said lower section.

7. The batting tee of claim 6 wherein said upper section of said ball support means is constructed of flexible material.

8. The batting tee of claim 6 wherein the upper end of said upper section of said ball support means is concave.

* * * * *